US007789934B2

(12) United States Patent
Suzuki et al.

(10) Patent No.: US 7,789,934 B2
(45) Date of Patent: Sep. 7, 2010

(54) LUBRICANT FOR POWDER METALLURGY, POWDERY MIXTURE FOR POWDER METALLURGY, AND PROCESS FOR PRODUCING SINTER

(75) Inventors: Hironori Suzuki, Takasago (JP); Kazuhisa Fujisawa, Kobe (JP); Takayasu Fujiura, Kobe (JP); Kiyoshi Horie, Kakogawa (JP); Masaki Kojima, Kakogawa (JP); Takeshi Yoshihara, Kakogawa (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 742 days.

(21) Appl. No.: 10/586,631

(22) PCT Filed: Jan. 19, 2005

(86) PCT No.: PCT/JP2005/000945

§ 371 (c)(1),
(2), (4) Date: Jul. 19, 2006

(87) PCT Pub. No.: WO2005/068588

PCT Pub. Date: Jul. 28, 2005

(65) Prior Publication Data

US 2007/0154340 A1 Jul. 5, 2007

(30) Foreign Application Priority Data

Jan. 20, 2004 (JP) ..... 2004-011475

(51) Int. Cl.
*B22F 3/12* (2006.01)

(52) U.S. Cl. ..... 75/252

(58) Field of Classification Search ..... 508/100
See application file for complete search history.

(56) References Cited

U.S. PATENT DOCUMENTS

| | | | | |
|---|---|---|---|---|
| 5,952,274 | A * | 9/1999 | Rieckert et al. | 508/554 |
| 6,323,159 | B1 * | 11/2001 | Raza | 508/100 |
| 6,376,585 | B1 | 4/2002 | Schofalvi et al. | |
| 6,679,935 | B2 | 1/2004 | Hammond | |
| 6,846,862 | B2 | 1/2005 | Schofalvi et al. | |
| 7,183,242 | B2 | 2/2007 | Hammond | |
| 7,192,464 | B2 | 3/2007 | Hammond | |
| 7,264,646 | B2 | 9/2007 | Hammond | |
| 2004/0077508 | A1 | 4/2004 | Hammond | |
| 2005/0044988 | A1 | 3/2005 | Hammond | |
| 2007/0048166 | A1 | 3/2007 | Hammond | |
| 2007/0077164 | A1 | 4/2007 | Hammond et al. | |

FOREIGN PATENT DOCUMENTS

| | | | |
|---|---|---|---|
| JP | 05221946 | * | 8/1993 |
| JP | 06 145701 | | 5/1994 |
| JP | 6 506726 | | 7/1994 |
| JP | 10 501270 | | 2/1998 |
| JP | 10 280005 | | 10/1998 |
| JP | 10 317001 | | 12/1998 |
| JP | 2001 342478 | | 12/2001 |

* cited by examiner

*Primary Examiner*—Roy King
*Assistant Examiner*—Yoshitoshi Takeuchi
(74) *Attorney, Agent, or Firm*—Oblon, Spivak, McClelland, Maier & Neustadt, L.L.P.

(57) ABSTRACT

A lubricant for powder metallurgy which includes a polyhydroxycarboxylic acid amide. The lubricant improves both flowability and lubricity, irrespective of a presence or absence of any complicated pretreatment step.

20 Claims, 1 Drawing Sheet

LUBRICANT FOR POWDER METALLURGY, POWDERY MIXTURE FOR POWDER METALLURGY, AND PROCESS FOR PRODUCING SINTER

TECHNICAL FIELD

The present invention relates to a technique for producing a sintered body by shaping and sintering a metal powder, more precisely to a lubricant for powder metallurgy that may be utilized in shaping a metal powder, to a mixed powder for powder metallurgy prepared by mixing the lubricant and a metal powder, and to a method for producing a sintered body by the use of the mixed powder for powder metallurgy.

BACKGROUND ART

In powder metallurgy of using a metal powder such as iron powder or steel powder as the essential material, a powder such as an alloying ingredient or graphite powder is added to and mixed with the essential material powder as the component for improving the physical properties (strength characteristic and workability characteristic) of the sintered body, then a lubricant is further added thereto and this is shaped by compression to give a green compact, and thereafter the green compact is sintered into a sintered body. In the powder metallurgy method, when the mixed powder is discharged out of a storage hopper or when the mixed powder is filled into a mold, the flowability of the mixed powder is one important characteristic factor. Specifically, when the flowability of the mixed powder is poor, then it may cause some problems in that the powder may bridge the upper area of the hopper discharge port, there by resulting in discharge failure, and that the powder may clog the hose from the hopper to a shoebox. Even when a mixed powder of poor flowability could be forcedly discharged out through a hose, it could not fill a mold, especially the thin-wall area of a mold and therefore a good shaped article could not be produced. Accordingly, the demand for a mixed powder of good flowability is strong.

It is considered that the flowability of a mixed powder may depend on the particle size and the shape of the metal powder used, the type and the amount as well as the particle size and the shape of an additive element to be added thereto for improving physical properties, but may be influenced mostly by the type and the amount of a lubricant to be added to it. The uppermost limit of the amount of the lubricant may be generally up to 0.1% by mass, and with the increase in its amount, the flowability of the mixed powder may worsen. Therefore, from the viewpoint of the flowability of the mixed powder, the amount of the lubricant to be added thereto is preferably lower. However, when the amount of the lubricant is lowered, then the lubricity of the mixed powder may extremely lower, and as a result, when the shaped article is taken out of a mold, then the friction coefficient between the shaped article and the mold surface may increase whereby the article may be galled by the mold or the mold may be damaged. Accordingly, it has been difficult to satisfy both the lubricity and the flowability in powder metallurgy.

From the viewpoint of the type and the melting point of the lubricant to be used therein, it is also difficult to satisfy both the lubricity and the flowability in powder metallurgy. Specifically, stearic acid and stearic acid amide having a low melting point generally have good lubricity, but when such a low-melting-point lubricant is used, then the powder may aggregate and its flowability may worsen. In particular, the failure is remarkable when the ambient temperature is high. On the contrary, metal soap and ethylene-bisamide having a high melting point could keep good flowability even at a high ambient temperature, but their lubricity is inferior to that of the above-mentioned low-melting-point stearic acid amide, etc.

For satisfying both the flowability and the lubricity, for example, JP-A-10-317001 is known. In this publication, the surfaces of metal powder particles are coated with an organic compound (e.g., organoalkoxysilane, organosilazane, titanate-type or fluorine-containing coupling agent) that is stable even up to a high-temperature range (about 200° C.), whereby the frictional resistance thereof is reduced and the contact charge thereof is prevented so as to improve the flowability of the particles. In addition, the publication says that the compound may also improve the lubricity of the particles. Further, the publication says that the organoalkoxysilane and others may react with the hydroxyl groups existing in the surfaces of the metal powder particles through condensation to form chemical bonds for surface modification. However, the method in this publication requires the complicated step (for pretreatment) of previously spraying the organic compound on the metal powder particles so as to coat their surfaces, additionally requiring removal of the solvent used for the coating (spraying) by drying the particles, and therefore it is unsuitable for industrial-scale production.

In JP-A-10-317001, a fatty acid monoamide (e.g., ethylene-stearic acid monoamide) or a fatty acid bisamide (e.g., ethylene-stearic acid bisamide) is additionally used as a lubricant. However, the lubricant is ineffective for improvement of flowability, as so mentioned hereinabove.

DISCLOSURE OF THE INVENTION

The present invention has been made in consideration of the above-mentioned situation, and its object is to provide a lubricant for powder metallurgy capable of improving both flowability and lubricity irrespective of the presence or absence of a complicated pretreatment step, to provide a mixed powder for powder metallurgy prepared by mixing the lubricant and a metal powder, and to provide a method for producing a sintered body by the use of the mixed powder for powder metallurgy.

We, the present inventors have assiduously studied for the purpose of solving the above-mentioned problems, and, as a result, have found that a polyhydroxycarboxylic acid amide may improve both flowability and lubricity irrespective of the presence or absence of any complicated pretreatment step, and have completed the present invention.

Specifically, the lubricant for powder metallurgy of the invention is essentially characterized in that it contains a polyhydroxycarboxylic acid amide of the following formula (1):

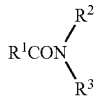

(1)

[In the formula, $R^1$ represents an alkyl group substituted with plural hydroxyl groups. The number of the carbon atoms constituting the alkyl group is (a) from 2 to 10, or (b) an integer selected from a range of from n to 5×n (in which n indicates the number of the substituted hydroxyl groups). $R^2$ represents a hydrocarbon group having from 8 to 30 carbon atoms; and $R^3$ represents a hydrogen atom, or a hydrocarbon group having from 1 to 30 carbon atoms.]

The polyhydroxycarboxylic acid amide (1) is preferably an aldonic acid amide; $R^1$ preferably has 5 carbons atoms; and $R^3$ is preferably a hydrogen atom. The mean particle size of the lubricant may be, for example, from 1 to 300 μm or so.

The lubricant for powder metallurgy of the invention may further contain an auxiliary lubricant. The auxiliary lubricant includes a metal soap, an alkylenebis-fatty acid amide, and a fatty acid amide of the following formula (2):

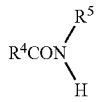

(2)

(In the formula, $R^4$ represents a hydrocarbon group having from 7 to 29 carbon atoms. $R^5$ represents a hydrogen atom, or a hydrocarbon group having from 1 to 30 carbon atoms.)

Preferred fatty acid amides (2) are (N-octadecenyl)hexadecanoic acid amide and (N-octadecyl)docosenoic acid amide. The ratio by mass of the polyhydroxycarboxylic acid amide (1) to the auxiliary lubricant (former/latter) may be, for example, from 30/70 to less than 100/0 or so.

The lubricant for powder metallurgy of the invention may contain a fatty acid along with the auxiliary lubricant. The fatty acid is preferably a saturated aliphatic monocarboxylic acid having from 16 to 22 carbon atoms. In case where a fatty acid is in the lubricant, then it is recommended that a part of the amount of the polyhydroxycarboxylic acid amide (1) to be therein is cancelled and the same mass as the cancelled amount of a fatty acid is used in the lubricant. The ratio by mass of the polyhydroxycarboxylic acid amide (1) to the fatty acid (former/latter) may be from 20/80 to less than 100/0.

The invention includes a mixed powder for powder metallurgy prepared by mixing the above-mentioned lubricant for powder metallurgy and a metal powder.

A sintered body may be produced by shaping the metal-mixed powder through compression, followed by sintering it.

BEST MODE FOR CARRYING OUT THE INVENTION

Figure 1:
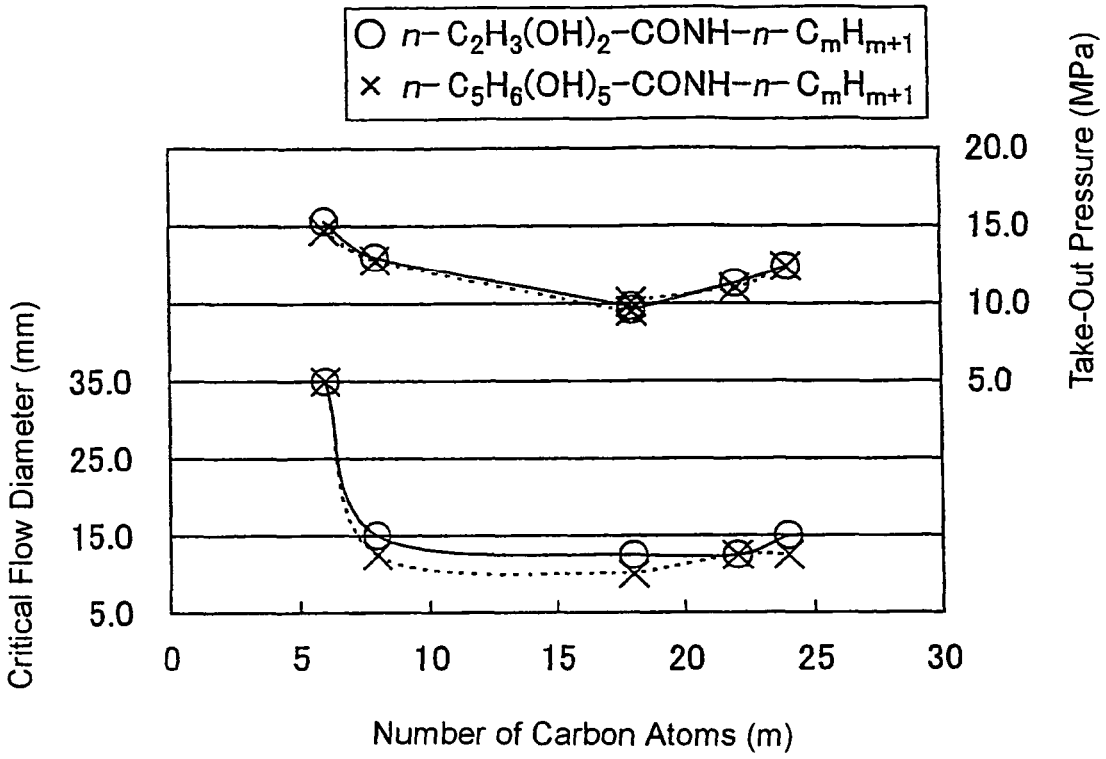
FIG. 1 is a graph showing the relationship between the number of carbon atoms (m) constituting a polyhydroxycarboxylic acid amide (1) and a critical flow diameter or a take-out pressure.

The lubricant for powder metallurgy of the invention contains a polyhydroxycarboxylic acid amide. The polyhydroxycarboxylic acid amide is a compound that may be superficially considered as a compound formed of a polyhydroxyalkylcarboxylic acid and a primary or secondary amine having a long-chain hydrocarbon group, and when the polyhydroxycarboxylic acid amide of the type is mixed with a metal powder (e.g., iron powder or iron-base powder such as steel powder) and once stored in a hopper and when the mixed powder (shaping powder) is discharged out of the hopper into a mold, then the amide may increase the flowability of the mixed powder. In addition, after the mixed powder is molded in the mold, the amide may increase the lubricity of the molded article to be taken out of the mold.

Probably, the effect of the polyhydroxycarboxylic acid amide may be because of the following reasons: While the acid amide is mixed with a metal powder or while it is in a molded article in a mold, then it may be so oriented that the part of the polyhydroxyalkyl group thereof may interact with the metal powder or the mold (presumably through hydrogen bonding) and the oleophilic long-chain hydrocarbon group on the amino group side may face outward to thereby form a layered structure. Accordingly, it is believed that the layered long-chain hydrocarbon group may improve the flowability and the lubricity of the mixed powder. Ordinary lubricants (e.g., metal soap, stearic acid amide) may also form a layered structure of the long-chain hydrocarbon group thereof. However, as compared with these, the polyhydroxycarboxylic acid amide of the invention may improve both flowability and lubricity, and it is believed that the reason for it may be because the acid amide of the invention surely forms the layered structure.

For surely forming the layered structure, the affinity between the polyhydroxycarboxylic acid and a metal powder or a mold is important, and from this viewpoint, the number of the hydroxyl groups in the polyhydroxyalkyl group moiety and the number of the carbon atoms constituting the alkyl group are important. In addition, it is considered that the thickness of the layer to be formed of the hydrocarbon group on the N side or the orientation of the hydrocarbon group may also be important, and from this viewpoint, the number of the carbon atoms constituting the hydrocarbon group is important. Accordingly, in the invention, the polyhydroxycarboxylic acid amide of the following formula (1) is used.

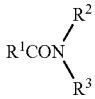

(1)

(In the formula, $R^1$ represents an alkyl group substituted with plural hydroxyl groups. $R^2$ represents a hydrocarbon group having from 8 to 30 carbon atoms; and $R^3$ represents a hydrogen atom, or a hydrocarbon group having from 1 to 30 carbon atoms.)

The polyhydroxycarboxylic acid amide of formula (1) may be superficially considered as a dewatered product of $R^1COOH$ and $R^2R^3NH$, but may be produced in any other method.

The number of the carbon atoms constituting the alkyl group for $R^1$ may be, for example, from 2 to 10 (preferably from 4 to 6, more preferably 5) or so. The number of the carbon atoms constituting the alkyl group for $R^1$ may be defined in accordance with the number, n, of the hydroxyl groups with which the alkyl group is substituted, and for example, it may be selected from integers falling within a range of from n to 5×n (preferably up to 3×n, more preferably up to 2.5×n). Especially preferably, it is the same as the number, n, of the substituted hydroxyl groups.

The number, n, of the hydroxyl groups is, for example at least 2 (preferably at least 3, more preferably at least 4). The uppermost limit of the number, n, of the hydroxyl groups may be naturally defined by the number of the carbon atoms constituting $R^1$, and may be, for example, at most 10 (preferably at most 8, more preferably at most 6) or so. It may be 5.

With increasing the number, n, of the hydroxyl groups, or with relatively decreasing the number of the carbon atoms constituting $R^1$ relative to the number, n, of the hydroxyl groups, the interaction between the part $R^1$ of the compound and a metal powder may be stronger.

Preferably, $R^1COOH$ is aldonic acid. Aldonic acid is a polyhydroxycarboxylic acid that corresponds to a compound prepared by oxidizing the aldehyde group of aldose into a carboxyl group, and for example, it includes a compound of the following formula (3):

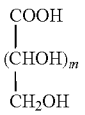

(3)

(In the formula, m represents a natural number, preferably indicating from 1 to 9, more preferably from 3 to 5, even more preferably 4.)

The aldonic acid includes, for example, glyceric acid, erythronic, threonic acid, ribonic acid, arabinonic acid, xylonic acid, lyxonic acid, allonic acid, altronic acid, gluconic acid, mannonic acid, gulonic acid, indonic acid, galactonic acid, talonic acid.

The hydrocarbon group to form $R^2$ includes a saturated hydrocarbon group (e.g., alkyl group) and an unsaturated hydrocarbon group (e.g., alkenyl group, alkynyl group). The number of the unsaturated bonds in the unsaturated hydrocarbon group may be one or more (for example, from 2 to 6 or so, preferably 2 or 3 or so), and in case where plural unsaturated bonds are in the group, then the group may contain both unsaturated double bonds and unsaturated triple bonds. Preferably, the hydrocarbon group is an alkyl group. Preferably, the hydrocarbon group is linear, in which, however, the carbon atoms constituting the linear chain (backbone chain) may be substituted with one or more lower alkyl groups (for example, alkyl groups having from 1 to 6 carbon atoms, preferably from 1 to 3 carbon atoms or so, provided that the number of the carbon atoms constituting the alkyl group is smaller than that of the carbon atoms constituting the backbone chain). Preferably, the number of the carbon atoms constituting the hydrocarbon group is at least 12 (more preferably at least 16) and is at most 24 (more preferably at most 22). In case where the hydrocarbon group is substituted with a lower alkyl group, then the number of the carbon atoms constituting the backbone chain thereof may be, for example, at least 5, preferably at least 8, more preferably at least 10. When the number of the carbon atoms constituting the hydrocarbon group is larger, then the compound is more effective for improving flowability and lubricity since the hydrophilicity of the layered moiety of the layered structure formed by the compound may be higher. However, if the number of the carbon atoms is too large, then the flowability and the lubricity may lower since the hydrocarbon group may be readily bent.

The improvement of flowability and lubricity may be attained essentially by $R^2$, and therefore $R^3$ may be selected from a broader range than that for $R^2$. For example, it may be broadly selected from a linear hydrocarbon group and a branched hydrocarbon group. Further, it may be a hydrogen atom, and is preferably a hydrogen atom. The hydrocarbon group for $R^3$ includes a saturated hydrocarbon group (alkyl group) and an unsaturated hydrocarbon group (alkenyl group, alkynyl group), and is preferably an alkyl group. The number of the carbon atoms constituting the group is preferably at most 26, more preferably at most 24 or so.

$R^2R^3NH$ includes, for example, the following compounds.

[When $R^2$=linear alkyl group, $R^3$=hydrogen atom]

For example, it includes octylamine, nonylamine, decylamine, undecylamine, dodecylamine, tridecylamine, tetradecylamine, pentadecylamine, hexadecylamine, heptadecylamine, octadecylamine, nonadecylamine, eicosylamine, heneicosylamine, docosylamine, tricosylamine, tetracosylamine.

[When $R^2$=lower alkyl group-substituted alkyl group, $R^3$=hydrogen atom]

For example, when the alkyl group is substituted with one lower alkyl group, the compound includes 2-ethylhexylamine, 4-propylpentylamine, 4-ethylpentylamine, 2-methyldecylamine, 3-methyldecylamine, 4-methyldecylamine, 5-methyldecylamine, 6-methyldecylamine, 7-methyldecylamine, 9-methyldecylamine, 6-ethylnonylamine, 5-propyloctylamine, 3-methylundecylamine, 6-propylnonylamine, 2-methyldodecylamine, 3-methyldodecylamine, 4-methyldodecylamine, 5-methyldodecylamine, 11-methyldodecylamine, 7-propyldecylamine, 2-methyltridecylamine, 12-methyltridecylamine, 2-methyltetradecylamine, 4-methyltetradecylamine, 13-methyltetradecylamine, 14-methylpentadecylamine, 2-ethyltetradecylamine, 15-methylhexadecylamine, 2-propyltetradecylamine, 2-ethylhexadecylamine, 14-ethylhexadecylamine, 14-methylheptadecylamine, 15-methylheptadecylamine, 16-methylheptadecylamine, 2-butyltetradecylamine, 2-methyloctadecylamine, 3-methyloctadecylamine, 4-methyloctadecylamine, 5-methyloctadecylamine, 6-methyloctadecylamine, 7-methyloctadecylamine, 8-methyloctadecylamine, 9-methyloctadecylamine, 10-methyloctadecylamine, 11-methyloctadecylamine, 14-methyloctadecylamine, 15-methyloctadecylamine, 16-methyloctadecylamine, 17-methyloctadecylamine, 15-ethylpentadecylamine, 3-methylnonadecylamine, 2-ethyloctadecylamine, 2-methyleicosylamine, 2-propyloctadecylamine, 2-butyloctadecylamine, 2-methyldodecylamine, 10-methyldocosylamine, 2-pentyloctadecylamine, 2-methyltricosylamine, 3-methyltricosylamine, 22-methyltricosylamine, 20-ethyldocosylamine, 18-propylhexaeicosylamine, 2-hexyloctadecylamine, 12-hexyloctadecylamine.

When the alkyl group is substituted with plural lower alkyl groups, the compound includes 2-butyl-5-methylpentylamine, 2-isobutyl-5-methylpentylamine, 2,3-dimethylnonylamine, 4,8-dimethylnonylamine, 2-butyl-5-methylhexylamine, 4,4-dimethyldecylamine, 2-ethyl-3-methylnonylamine, 2,2-dimethyl-4-ethyloctylamine, 2-propyl-3-methylnonylamine, 2,2-dimethyldodecylamine, 2,3-dimethyldodecylamine, 4,10-dimethyldodecylamine, 2-butyl-3-methylnonylamine, 2-butyl-2-ethylnonylamine, 3-ethyl-3-butylnonylamine, 4-butyl-4-ethylnonylamine, 3,7,11-trimethyldodecylamine, 2,2-dimethyltetradecylamine, 3,3-dimethyltetradecylamine, 4,4-dimethyltetradecylamine, 2-butyl-2-pentylheptylamine, 2,3-dimethyltetradecylamine, 4,8,12-trimethyltridecylamine, 14,14-dimethylpentadecylamine, 3-methyl-2-heptylnonylamine, 2,2-dipentylheptylamine, 2,2-dimethylhexadecylamine, 2-octyl-3-methylnonylamine, 2,3-dimethylheptadecylamine, 2,2-dimethyloctadecylamine, 2,3-dimethyloctadecylamine, 2,4-dimethyloctadecylamine, 3,3-dimethyloctadecylamine, 2-butyl-2-heptylnonylamine, 20,20-dimethylheneicosylamine.

[When $R^2$=alkenyl group, $R^3$=hydrogen atom]

The compound having one unsaturated bond includes, for example, 2-octenylamine, 3-octenylamine, 2-nonenylamine, 2-nonenylamine, 2-decenylamine, 4-decenylamine, 9-decenylamine, 9-hendecenylamine, 10-hendecenylamine, 2-dodecenylamine, 3-dodecenylamine, 5-dodecenylamine, 11-dodecenylamine, 2-tridecenylamine, 12-tridecenylamine, 4-tetradecenylamine, 5-tetradecenylamine, 9-tetradecenylamine, 2-pentadecenylamine, 14-pentadecenylamine, 2-hexadecenylamine, 7-hexadecenylamine, 9-hexadecenylamine, 2-heptadecenylamine, 6-octadecenylamine, 9-octadecenylamine, 11-octadecenylamine, 9-eicosenylamine, 11-eicosenylamine, 11-docosenylamine, 13-docosenylamine, 15-tetracosenylamine.

The compound having plural unsaturated bonds includes, for example, trans-8,trans-10-octadecadienylamine, cis-9, cis-12-octadecadienylamine, trans-9,trans-12-octadecadienylamine, cis-9,trans-11-octadecadienylamine, trans-10, cis-12-octadecadienylamine, cis-9,cis-12-octadecadienylamine, cis-10,cis-12-octadecadienylamine, trans-10,trans-12-octadecadienylamine, trans-9,trans-11-octadecadienylamine, trans-8,trans-10-octadecadienylamine, trans-9,trans-11-octadecadienylamine, cis-9,trans-11,trans-13-octadecatrienylamine, trans-9,tarns-11,trans-13-octadecatrienylamine, cis-9,cis-12,cis-15-octadecatrienylamine, trans-9,trans-12,trans-15-octadecatrienylamine, trans-10, trans-12,trans-14-octadecatrienylamine, 9,11,13,15-octadecatetraenylamine, 2,2-dimethyl-cis-9,cis-12-octadecadienylamine, 8,11,14-eicosatrienylamine, 12,20-heneicosadienylamine, 9,13-docosadienylamine, 4,8,12,15, 19-docosapentaenylamine, 2,2-dimethyl-cis-11,cis-14-eicosadienylamine, 9,15-tetracosadienylamine, 5,8,11-eicosatrienylamine, 7,10,13-docosatrienylamaine, 8,11,14-docosatrienylamine, 4,8,11,14-hexadecatetraenylamine, 6,9, 12,15-hexadecatetraenylamine, 4,8,12,15-octadecatetraenylamine, 9,11,13,15-octadecatetraenylamine, 4,8,12,16-eicosatetraenylamine, 5,8,11,14-eicosatetraenylamine, 4,7,10,13-docosahexaenylamine, 4,8,12,15,18-eicosapentaenylamine, 4,8,12,15,19-docosapentaenylamine.

The compound substituted with a lower alkyl group includes, for example, 2-methyl-2-heptenylamine, 3-methyl-2-nonenylamine, 5-methyl-2-nonenylamine, 5-methyl-2-undecenylamine, 2-methyl-2-dodecenylamine, 5-methyl-2-tridecenylamine, 2-methyl-9-octadecenylamine, 2-ethyl-9-octadecenylamine, 2-propyl-9-octadecenylamine, 2-methyl-2-eicosenylamine, 5,9-dimethyl-2-decenylamine, 2,5-dimethyl-2-heptadecenylamine, 2,2-dimethyl-11-eicosenylamine.

[When $R^2$=alkynyl group, $R^3$=hydrogen atom]

The compound may have one or more unsaturated bonds and may be substituted with a lower alkyl group, including, for example, 2-octynylamine, 7-octynylamine, 2-nonynylamine, 2-decynylamine, 2-undecynylamine, 6-undecynylamine, 9-undecynylamine, 10-undecynylamine, 6-dodecynylamine, 7-dodecynylamine, 8-tridecynylamine, 9-tridecynylamine, 7-tetradecynylamine, 7-hexadecynylamine, 2-heptadecynylamine, 5-octadecynylamine, 6-octadecynylamine, 7-octadecynylamine, 8-octadecynylamine, 9-octadecynylamine, 10-octadecynylamine, 11-octadecynylamine, 9-nonadecynylamine, 12-nonadecynylamine, 12-octadecynylamine, 13-docosynylamine, 11,16-docosadiynylamine, 7,15-docosadiynylamine, 8,15-docosadiynylamine, 21-tricosynylamine, 22-tricosynylamine.

Especially preferred examples of the polyhydroxycarboxylic acid amide (1) are (N-long-chain-alkyl)aldonic acid amides, for example, those of the following formula (4):

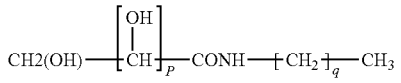

(4)

[In the formula, p indicates an integer of from 1 to 9 (preferably from 1 to 4); q indicates an integer of from 7 to 29 (preferably from 11 to 23, more preferably from 15 to 21).]

The polyhydroxycarboxylic acid amide (1) may be produced in various methods, for which amidation starting from $R^1COOH$ or its equivalent form and $R^2R^3NH$ may be utilized in a simplified manner. $R^1COOH$ and $R^2R^3NH$ may be amidated, for example, through dehydrating condensation. For the equivalent form, usable are acid halides and esters (including lactones). In particular, when $R^1COOH$ is aldonic acid, then its ring-closed form (lactone form) is utilized relatively in many cases. The lactone form of aldonic acid includes, for example, γ-gluconolactone, δ-gluconolactone, γ-galactolactone.

The lubricant for powder metallurgy of the invention may comprise a polyhydroxycarboxylic acid (1) alone, but may additionally contain an auxiliary lubricant. For the auxiliary lubricant, herein usable are known (generally-used) lubricants for powder metallurgy or any other lubricants for powder metallurgy (but excepting fatty acids mentioned hereinunder). Known lubricants for powder metallurgy (auxiliary lubricants in the invention) are generally inferior to the polyhydroxycarboxylic acid amides (1) in point of their effect for improving flowability and for improving lubricity, but are useful for delicately controlling the properties (flowability-lubricity balance) of the polyhydroxycarboxylic acid amides (1) within a range thereof not giving any actual harm to the acid amides. The other lubricants for powder metallurgy (auxiliary lubricants) are ineffective for improvement of flowability but may have an excellent effect for improvement of lubricity. Accordingly, such auxiliary lubricant may also be useful for delicately controlling the properties of the polyhydroxycarboxylic acid amides (1).

Known lubricants for powder metallurgy (auxiliary lubricants) are, for example, metal soap and alkylenebis-fatty acid amides. The metal soap includes fatty acid salts, for example, fatty acid salts having at least 12 carbon atoms (preferably from 14 to 24 carbon atoms or so). In general, zinc stearate is used. The alkylenebis-fatty acid amides include, for example, $C_{2-6}$ alkylenebis-$C_{12-24}$ carboxylic acid amides. In general, ethylenebis-stearylamide is used.

The other lubricants for powder metallurgy (auxiliary lubricants) that may be additionally used herein for improvement of lubricity are, for example, fatty acid amides of the following formula (2):

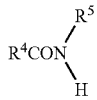

(2)

(In the formula, $R^4$ represents a hydrocarbon group having from 7 to 29 carbon atoms. $R^5$ represents a hydrogen atom, or a hydrocarbon group having from 1 to 30 carbon atoms.)

The fatty acid amides (2) may be superficially considered as a dehydrated product of $R^4COOH$ and $R^5NH_2$, but may be produced in any other methods.

Preferably, $R^4$ may be selected from the same range as that for $R^2$ mentioned hereinabove. However, the number of the carbon atoms constituting it is shifted smaller by one than that of $R^2$. $R^4COOH$ includes, for example, the following compounds.

[When $R^4$=linear alkyl group]

For example, the compound includes octanoic acid (caprylic acid), nonanoic acid, decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid, octadecanoic acid (stearic acid), nonadecanoic acid, eicosanoic acid, heneicosanoic acid, docosanoic acid, tricosanoic acid, tetracosanoic acid.

[When $R^4$=lower alkyl group-substituted alkyl group]

For example, the compound substituted with one lower alkyl group includes 2-ethylhexanoic acid, 4-propylpentanoic acid, 4-ethylpentanoic acid, 2-methyldecanoic acid, 3-methyldecanoic acid, 4-methyldecanoic acid, 5-methyldecanoic acid, 6-methyldecanoic acid, 7-methyldecanoic acid, 9-methyldecanoic acid, 6-ethylnonanoic acid, 5-propyloctanoic acid, 3-methylundecanoic acid, 6-propylnonanoic acid, 2-methyldodecanoic acid, 3-methyldodecanoic acid, 4-methyldodecanoic acid, 5-methyldodecanoic acid, 11-methyldodecanoic acid, 7-propyldecanoic acid, 2-methyltridecanoic acid, 12-methyltridecanoic acid, 2-methyltetradecanoic acid, 4-methyltetradecanoic acid, 13-methyltetradecanoic acid, 14-methylpentadecanoic acid, 2-ethyltetradecanoic acid, 15-methylhexadecanoic acid, 2-propyltetradecanoic acid, 2-ethylhexadecanoic acid, 14-ethylhexadecanoic acid, 14-methylheptadecanoic acid, 15-methylheptadecanoic acid, 16-methylheptadecanoic acid, 2-butyltetradecanoic acid, 2-methyloctadecanoic acid, 3-methyloctadecanoic acid, 4-methyloctadecanoic acid, 5-methyloctadecanoic acid, 6-methyloctadecanoic acid, 7-methyloctadecanoic acid, 8-methyloctadecanoic acid, 9-methyloctadecanoic acid, 10-methyloctadecanoic acid, 11-methyloctadecanoic acid, 14-methyloctadecanoic acid, 15-methyloctadecanoic acid, 16-methyloctadecanoic acid, 17-methyloctadecanoic acid, 15-ethylpentadecanoic acid, 3-methylnonadecanoic acid, 2-ethyloctadecanoic acid, 2-methyleicosanoic acid, 2-propyloctadecanoic acid, 2-butyloctadecanoic acid, 2-methyldocosanoic acid, 10-methyldocosanoic acid, 2-pentyloctadecanoic acid, 2-methyltricosanoic acid, 3-methyltricosanoic acid, 22-methyltricosanoic acid, 20-ethyldocosanoic acid, 18-propylhexaeicosanoic acid, 2-hexyloctadecanoic acid, 12-hexyloctadecanoic acid.

The compound substituted with plural lower alkyl groups includes 2-butyl-5-methylpentanoic acid, 2-isobutyl-5-methylpentanoic acid, 2,3-dimethylnonanoic acid, 4,8-dimethylnonanoic acid, 2-butyl-5-methylhexanoic acid, 4,4-dimethyldecanoic acid, 2-ethyl-3-methylnonanoic acid, 2,2-dimethyl-4-ethyloctanoic acid, 2-propyl-3-methylnonanoic acid, 2,2-dimethyldodecanoic acid, 2,3-dimethyldodecanoic acid, 4,10-dimethyldodecanoic acid, 2-butyl-3-methylnonanoic acid, 2-butyl-2-ethylnonanoic acid, 3-ethyl-3-butylnonanoic acid, 4-butyl-4-ethylnonanoic acid, 3,7,11-trimethyldodecanoic acid, 2,2-dimethyltetradecanoic acid, 3,3-dimethyltetradecanoic acid, 4,4-dimethyltetradecanoic acid, 2-butyl-2-pentylheptanoic acid, 2,3-dimethyltetradecanoic acid, 4,8,12-trimethyltridecanoic acid, 14,14-dimethylpentadecanoic acid, 3-methyl-2-heptylnonanoic acid, 2,2-dipentylheptanoic acid, 2,2-dimethylhexadecanoic acid, 2-octyl-3-methylnonanoic acid, 2,3-dimethylheptadecanoic acid, 2,2-dimethyloctadecanoic acid, 2,3-dimethyloctadecanoic acid, 2,4-dimethyloctadecanoic acid, 3,3-dimethyloctadecanoic acid, 2-butyl-2-heptylnonanoic acid, 20,20-dimethylheneicosanoic acid.

[When $R^4$=alkenyl group]

The compound having one unsaturated bond includes, for example, 2-octenoic acid, 3-octenoic acid, 2-nonenoic acid, 3-nonenoic acid, 2-decenoic acid, 4-decenoic acid, 9-decenoic acid, 9-hendecenoic acid, 10-hendecenoic acid, 2-dodecenoic acid, 3-dodecenoic acid, 5-dodecenoic acid, 11-dodecenoic acid, 2-tridecenoic acid, 12-tridecenoic acid, 4-tetradecenoic acid, 5-tetradecenoic acid, 9-tetradecenoic acid, 2-pentadecenoic acid, 14-pentadecenoic acid, 2-hexadecenoic acid, 7-hexadecenoic acid, 9-hexadecenoic acid, 2-heptadecenoic acid, 6-octadecenoic acid, 9-octadecenoic acid, 11-octadecenoic acid, 9-eicosenoic acid, 11-eicosenoic acid, 11-docosenoic acid, 13-docosenoic acid, 15-tetracosenoic acid.

The compound having plural unsaturated bonds includes, for example, trans-8,trans-12-octadecadienoic acid, cis-9,cis-12-octadecadienoic acid, trans-9,trans-12-octadecadienoic acid, cis-9,trans-11-octadecadienoic acid, trans-10,cis-12-octadecadienoic acid, cis-9,cis-12-octadecadienoic acid, cis-10,cis-12-octadecadienoic acid, trans-10,trans-12-octadecadienoic acid, trans-9,trans-11-octadecadienoic acid, trans-8,trans-10-octadecadienoic acid, trans-9,trans-11-octadecadienoic acid, cis-9,trans-11,trans-13-octadecatrienoic acid, trans-9,trans-11,trans-13-octadecatrienoic acid, cis-9,cis-11,trans-13-octadecatrienoic acid, cis-9,cis-12,cis-15-octadecatrienoic acid, trans-9,trans-12,trans-15-octadecatrienoic acid, trans-10,trans-12,trans-14-octadecatrienoic acid, 9,11,13,15-octadecatetraenoic acid, 2,2-dimethyl-cis-9,cis-12-octadecadienoic acid, 8,11,14-eicosatrienoic acid, 12,20-heneicosadienoic acid, 9,13-docosadienoic acid, 4,8,12,15,19-docosapentaenoic acid, 2,2-dimethyl-cis-11,cis-14-eicosadienoic acid, 9,15-tetracosadienoic acid, 5,8,11-eicosatrienoic acid, 7,10,13-docosatrienoic acid, 8,11,14-docosatrienoic acid, 4,8,11,14-hexadecatetraenoic acid, 6,9,12,15-hexadecatetraenoic acid, 4,8,12,15-octadecatetraenoic acid, 9,11,13,15-octadecatetraenoic acid, 4,8,12,16-eicosatetraenoic acid, 5,8,11,14-eicosatetraenoic acid, 4,7,10,13-docosahexaenoic acid, 4,8,12,15,18-eicosapentaenoic acid, 4,8,12,15,19-docosapentaenoic acid.

The compound substituted with a lower alkyl group includes, for example, 2-methyl-2-heptenoic acid, 3-methyl-2-nonenoic acid, 5-methyl-2-nonenoic acid, 5-methyl-2-undecenoic acid, 2-methyl-2-dodecenoic acid, 5-methyl-2-tridecenoic acid, 2-methyl-9-octadecenoic acid, 2-ethyl-9-octadecenoic acid, 2-propyl-9-octadecenoic acid, 2-methyl-2-eicosenoic acid, 2-methyl-2-hexacosenoic acid, 3,4-dimethyl-3-pentenoic acid, 5,9-dimethyl-2-decenoic acid, 2,5-dimethyl-2-heptadecenoic acid, 2,2-dimethyl-11-eicosenoic acid.

[When $R^4$=alkynyl group]

The compound may have one or more unsaturated bonds and may be substituted with a lower alkyl group, including, for example, 2-octynoic acid, 7-octynoic acid, 2-nonynoic acid, 2-decynoic acid, 2-undecynoic acid, 6-undecynoic acid, 9-undecynoic acid, 10-undecynoic acid, 6-dodecynoic acid, 7-dodecynoic acid, 8-tridecynoic acid, 9-tridecynoic acid, 7-tetradecynoic acid, 7-hexadecynoic acid, 2-heptadecynoic acid, 5-octadecynoic acid, 6-octadecynoic acid, 7-octadecynoic acid, 8-octadecynoic acid, 9-octadecynoic acid, 10-octadecynoic acid, 11-octadecynoic acid, 9-nonadecynoic acid, 12-nonadecynoic acid, 12-octadecynoic acid, 13-docosynoic acid, 11,16-docosadiynoic acid, 7,15-docosadiynoic acid, 8,15-docosadiynoic acid, 21-tricosynoic acid, 22-tricosynoic acid.

$R^5$ may be selected from the same range as that for $R^3$ mentioned above. More preferably, $R^5$ may be selected from the same range as that for $R^2$ mentioned above. $R^5NH_2$ includes, for example, the following compounds.

[When $R^5$=linear alkyl group]

For example, the compound includes octylamine, nonylamine, decylamine, undecylamine, dodecylamine, tridecylamine, tetradecylamine, pentadecylamine, hexadecylamine, heptadecylamine, octadecylamine, nonadecylamine, eicosylamine, heneicosylamine, docosylamine, tricosylamine, tetracosylamine.

[When $R^5$=lower alkyl group-substituted alkyl group]

For example, when the alkyl group is substituted with one lower alkyl group, the compound includes 2-ethylhexylamine, 4-propylpentylamine, 4-ethylpentylamine, 2-methyldecylamine, 3-methyldecylamine, 4-methyldecylamine, 5-methyldecylamine, 6-methyldecylamine, 7-methyldecylamine, 9-methyldecylamine, 6-ethylnonylamine, 5-propyloctylamine, 3-methylundecylamine, 6-propylnonylamine, 2-methyldodecylamine, 3-methyldodecylamine, 4-methyldodecylamine, 5-methyldodecylamine, 11-methyldodecylamine, 7-propyldecylamine, 2-methyltridecylamine, 12-methyltridecylamine, 2-methyltetradecylamine, 4-methyltetradecylamine, 13-methyltetradecylamine, 14-methylpentadecylamine, 2-ethyltetradecylamine, 15-methylhexadecylamine, 2-propyltetradecylamine, 2-ethylhexadecylamine, 14-ethylhexadecylamine, 14-methylheptadecylamine, 15-methylheptadecylamine, 16-methylheptadecylamine, 2-butyltetradecylamine, 2-methyloctadecylamine, 3-methyloctadecylamine, 4-methyloctadecylamine, 5-methyloctadecylamine, 6-methyloctadecylamine, 7-methyloctadecylamine, 8-methyloctadecylamine, 9-methyloctadecylamine, 10-methyloctadecylamine, 11-methyloctadecylamine, 14-methyloctadecylamine, 15-methyloctadecylamine, 16-methyloctadecylamine, 17-methyloctadecylamine, 15-ethylpentadecylamine, 3-methylnonadecylamine, 2-ethyloctadecylamine, 2-methyleicosylamine, 2-propyloctadecylamine, 2-butyloctadecylamine, 2-methyldococylamine, 10-methyldocosylamine, 2-pentyloctadecylamine, 2-methyltricosylamine, 3-methyltricosylamine, 22-methyltricosylamine, 20-ethyldocosylamine, 18-propylhexaeicosylamine, 2-hexyloctadecylamine, 12-hexyloctadecylamine.

When the alkyl group is substituted with plural lower alkyl groups, the compound includes, for example, 2-butyl-5-methylpentylamine, 2-isobutyl-5-methylpentylamine, 2,3-dimethylnonylamine, 4,8-dimethylnonylamine, 2-butyl-5-methylhexylamine, 4,4-dimethyldecylamine, 2-ethyl-3-methylnonylamine, 2,2-dimethyl-4-ethyloctylamine, 2-propyl-3-methylnonylamine, 2,2-dimethyldodecylamine, 2,3-dimethyldodecylamine, 4,10-dimethyldodecylamine, 2-butyl-3-methylnonylamine, 2-butyl-2-ethylnonylamine, 3-ethyl-3-butylnonylamine, 4-butyl-4-ethylnonylamine, 3,7,11-trimethyldodecylamine, 2,2-dimethyltetradecylamine, 3,3-dimethyltetradecylamine, 4,4-dimethyltetradecylamine, 2-butyl-2-pentylheptylamine, 2,3-dimethyltetradecylamine, 4,8,12-trimethyltridecylamine, 14,14-dimethylpentadecylamine, 3-methyl-2-heptylnonylamine, 2,2-dipentylheptylamine, 2,2-dimethylhexadecylamine, 2-octyl-3-methylnonylamine, 2,3-dimethylheptadecylamine, 2,2-dimethyloctadecylamine, 2,3-dimethyloctadecylamine, 2,4-dimethyloctadecylamine, 3,3-dimethyloctadecylamine, 2-butyl-2-heptylnonylamine, 20,20-dimethylheneicosylamine.

[When $R^5$=alkenyl group]

The compound having one unsaturated bond includes, for example, 2-octenylamine, 3-octenylamine, 2-nonenylamine, 2-nonenylamine, 2-decenylamine, 4-decenylamine, 9-decenylamine, 9-hendecenylamine, 10-hendecenylamine, 2-dodecenylamine, 3-dodecenylamine, 5-dodecenylamine, 11-dodecenylamine, 2-tridecenylamine, 12-tridecenylamine, 4-tetradecenylamine, 5-tetradecenylamine, 9-tetradecenylamine, 2-pentadecenylamine, 14-pentadecenylamine, 2-hexadecenylamine, 7-hexadecenylamine, 9-hexadecenylamine, 2-heptadecenylamine, 6-octadecenylamine, 9-octadecenylamine, 11-octadecenylamine, 9-eicosenylamine, 11-eicosenylamine, 11-docosenylamine, 13-docosenylamine, 15-tetracosenylamine.

The compound having plural unsaturated bonds includes, for example, trans-8,trans-10-octadecadienylamine, cis-9,cis-12-octadecadienylamine, trans-9,trans-12-octadecadienylamine, cis-9,trans-11-octadecadienylamine, trans-10,cis-12-octadecadienylamine, cis-9,cis-12-octadecadienylamine, cis-10,cis-12-octadecadienylamine, trans-10,trans-12-octadecadienylamine, trans-9,trans-11-octadecadienylamine, trans-8,trans-10-octadecadienylamine, trans-9,trans-11-octadecadienylamine, cis-9,trans-11,trans-13-octadecatrienylamine, trans-9,tarns-11,trans-13-octadecatrienylamine, cis-9,cis-12,cis-15-octadecatrienylamine, trans-9,trans-12,trans-15-octadecatrienylamine, trans-10,trans-12,trans-14-octadecatrienylamine, 9,11,13,15-octadecatetraenylamine, 2,2-dimethyl-cis-9,cis-12-octadecadienylamine, 8,11,14-eicosatrienylamine, 12,20-heneicosadienylamine, 9,13-docosadienylamine, 4,8,12,15,19-docosapentaenylamine, 2,2-dimethyl-cis-11,cis-14-eicosadienylamine, 9,15-tetracosadienylamine, 5,8,11-eicosatrienylamine, 7,10,13-docosatrienylamaine, 8,11,14-docosatrienylamine, 4,8,11,14-hexadecatetraenylamine, 6,9,12,15-hexadecatetraenylamine, 4,8,12,15-octadecatetraenylamine, 9,11,13,15-octadecatetraenylamine, 4,8,12,16-eicosatetraenylamine, 5,8,11,14-eicosatetraenylamine, 4,7,10,13-docosahexaenylamine, 4,8,12,15,18-eicosapentaenylamine, 4,8,12,15,19-docosapentaenylamine.

The compound substituted with a lower alkyl group includes, for example, 2-methyl-2-heptenylamine, 3-methyl-2-nonenylamine, 5-methyl-2-nonenylamine, 5-methyl-2-undecenylamine, 2-methyl-2-dodecenylamine, 5-methyl-2-tridecenylamine, 2-methyl-9-octadecenylamine, 2-ethyl-9-octadecenylamine, 2-propyl-9-octadecenylamine, 2-methyl-2-eicosenylamine, 5,9-dimethyl-2-decenylamine, 2,5-dimethyl-2-heptadecenylamine, 2,2-dimethyl-11-eicosenylamine.

[When $R^4$=alkynyl group]

The compound may have one or more unsaturated bonds and may be substituted with a lower alkyl group, including, for example, 2-octynylamine, 7-octynylamine, 2-nonynylamine, 2-decynylamine, 2-undecynylamine, 6-undecynylamine, 9-undecynylamine, 10-undecynylamine, 6-dodecynylamine, 7-dodecynylamine, 8-tridecynylamine, 9-tridecynylamine, 7-tetradecynylamine, 7-hexadecynylamine, 2-heptadecynylamine, 5-octadecynylamine, 6-octadecynylamine, 7-octadecynylamine, 8-octadecynylamine, 9-octadecynylamine, 10-octadecynylamine, 11-octadecynylamine, 9-nonadecynylamine, 12-nonadecynylamine, 12-octadecynylamine, 13-docosynylamine, 11,16-docosadiynylamine, 7,15-docosadiynylamine, 8,15-docosadiynylamine, 21-tricosynylamine, 22-tricosynylamine.

Especially preferred fatty acid amides (2) are those prepared from an alkane or alkene-carboxylic acid having from 16 to 22 carbon atoms or so and a monoalkane or monoalkene-amine having from 16 to 22 carbon atoms (preferably having 18 carbon atoms or so); and more preferred are amides in which one of the carboxylic acid-derived hydrocarbon group and the amine-derived hydrocarbon group is a saturated hydrocarbon group and the other is an unsaturated hydrocarbon group [in particular, (N-octadecenyl)hexadecanoic acid amide, (N-octadecyl)docosenoic acid amide].

The ratio by mass of the polyhydroxycarboxylic acid amide (1) to the auxiliary lubricant (former/latter) may be suitably defined, depending on the properties of the auxiliary lubricant (hereinafter the ratio by mass may be referred to as a first ratio by mass). The first ratio by mass may be selected from a range of, for example, at least 30/70 (preferably at least 40/60, more preferably at least 60/40) and less than 100/0 (preferably at most 95/5, more preferably at most 90/10).

In case where the lubricant for powder metallurgy contains the auxiliary lubricant, then it may further contain a fatty acid along with it. The lubricant for powder metallurgy that contains a polyhydroxycarboxylic acid amide (1), an auxiliary lubricant and a fatty acid may greatly improve both lubricity and flowability.

For the fatty acid, for example, usable are compounds exemplified hereinabove as $R^4COOH$. One or more such compounds may be used herein either singly or as combined. The preferred range of the fatty acid may also be the same as that for $R^4COOH$ mentioned above. More preferred fatty acids are those having from 16 to 22 carbon atoms or so. Especially preferred fatty acids are aliphatic saturated monocarboxylic acids.

In case where such a fatty acid is in the lubricant, then it is recommended that a part of the amount of the polyhydroxycarboxylic acid amide (1) to be therein is cancelled and the same mass as the cancelled amount of a fatty acid is used in the lubricant. Specifically, it is desirable that the ratio by mass of the total of the polyhydroxycarboxylic acid amide (1) and the fatty acid to the auxiliary lubricant (former/latter) is equal to the numerical value indicated by the first ratio by mass as above.

The ratio by mass of the polyhydroxycarboxylic acid amide (1) to the fatty acid (former/latter) may be, for example, at least 20/80 (preferably at least 30/70, more preferably at least 35/65) and less than 100/0 (preferably at most 90/10, more preferably at most 80/20).

In case where the lubricant for powder metallurgy contains the above-mentioned auxiliary lubricant and fatty acid, in addition to the polyhydroxycarboxylic acid amide (1), the sequence of mixing these ingredients is not specifically defined. For example, in case where the lubricant for powder metallurgy contains both a polyhydroxycarboxylic acid amide (1) and an auxiliary lubricant, then the polyhydroxycarboxylic acid amide (1) and the auxiliary lubricant may be previously mixed to prepare a mixed lubricant, before mixed with a metal powder; or they are not premixed but the polyhydroxycarboxylic acid amide (1) and the auxiliary lubricant may be separately mixed with a metal powder in any suitable order. In case where the lubricant for powder metallurgy contains a polyhydroxycarboxylic acid amide (1), an auxiliary lubricant and a fatty acid, then the polyhydroxycarboxylic acid amide (1), the auxiliary lubricant and the fatty acid may be previously mixed to prepare a mixed lubricant, before mixed with a metal powder; or they are not premixed but the polyhydroxycarboxylic acid amide (1), the auxiliary lubricant and the fatty acid may be separately mixed with a metal powder in any suitable order.

The lubricant for powder metallurgy of the invention has a substantially powdery morphology, and it is recommended that its mean particle size is, for example, at least 1 μm, preferably at least 5 μm, more preferably at least 10 μm or so. Having a mean particle size of at least a predetermined value, the lubricant may be prevented from penetrating into the space between metal powder particles and therefore it may be fully effective for improvement of lubricity. On the other hand, however, if the mean particle size is too large, then the lubricant may be effective for improvement of lubricity and flowability, but it may roughen the surfaces of shaped articles and therefore good shaped articles or sintered bodies may be difficult to produce. Accordingly, it is recommended that the mean particle size of the lubricant may be at most 300 μm (preferably at most 100 μm, more preferably at most 50 μm) or so.

In case where a mixed powder (mixed lubricant) comprising a polyhydroxycarboxylic acid amide (1) and an auxiliary lubricant is used for the lubricant for powder metallurgy, then the mean particle size R(y) of the auxiliary lubricant may be smaller than the mean particle size R(x) of the polyhydroxycarboxylic acid amide (1), but it is recommended that the mean particle size R(y) is larger than the mean particle size R(x) [provided that both the mean particle size R(x) and R(y) are preferably within the above-mentioned predetermined range]. When the mean particle size R(y) of the auxiliary lubricant is larger than the mean particle size R(x) of the polyhydroxycarboxylic acid amide (1), then the polyhydroxycarboxylic acid amide (1) may adhere to the surface of the auxiliary lubricant to form a complex of the two, merely by mixing the two. All the polyhydroxycarboxylic acid amide (1) does not always form the complex, but in general, a part of it may form the complex.

The above-mentioned mean particle size is meant to indicate the 50% particle size (cumulative mean diameter) of the cumulative particle size distribution curve of the powder. For example, it may be determined by the use of a microtrack particle sizer (Nikkiso's X-100). A recommended condition for the measurement is as follows: The "presence or absence of light transmission through sample" is set as "presence"; the "presence or absence of spherical morphology" is set as "absence" (a spherical); the refractive index is 1.81; and the solvent to be used is water. A recommended pretreatment of the sample is as follows: 0.2 g of the sample is diluted with 50 ml of pure water, and a few drops of surfactant are added for dispersing the sample. In general, one sample is analyzed twice, and the data are averaged to give a mean value that is employed herein.

The lubricant for powder metallurgy of the invention may be mixed with a metal powder (e.g., iron-base powder) and optionally with an alloying metal powder (e.g., copper powder, nickel powder, phosphorus alloy powder, graphite powder) and a property-improving additive (e.g., manganese sulfide to be used for improving machinability, as well as talc, calcium fluoride) to prepare a mixed powder for powder metallurgy (shaping powder). In addition, for preventing segregation or dust formation, a binder may be added to it. In general, the mixed powder may be stored in a hopper, and is discharged out into a mold from the storage hopper to form a shaped article. Since the lubricant for powder metallurgy of the invention contains a polyhydroxycarboxylic acid amide (1), it improves the flowability of the mixed powder discharged out of the hopper, and further improves the lubricity of the shaped article to be taken out of the mold. In addition, not requiring any complicated pretreatment step, or that is, only when simply mixed with a metal powder and others, the lubricant for powder metallurgy may improve both the flowability and the lubricity.

The amount of the lubricant for powder metallurgy of the invention to be used may be, for example, at least 0.01% by mass (preferably at least 0.1% by mass, more preferably at least 0.3% by mass) and at most 2% by mass (preferably at most 1.5% by mass, more preferably at most 1.0% by mass) or so, relative to the overall amount of the mixed powder for powder metallurgy. If the amount of the lubricant for powder metallurgy is insufficient, then the lubricity may be poor. On the other hand, even if it is used excessively, not only the lubricity may be saturated but also the flowability and the compressibility may lower.

The lubricant for powder metallurgy is generally mixed with a metal powder, as so mentioned hereinabove, but the lubricant may be directly sprayed on a mold before used for molding therein (this is referred to as a mold-lubricated molding method) so that the lubricant to be mixed with a metal powder may be reduced.

The shaped article obtained in the manner as above may be sintered to give a sintered body.

As described in detail hereinabove, the lubricant for powder metallurgy of the invention contains a polyhydroxycarboxylic acid amide (1) and therefore satisfies both flowability and lubricity in powder metallurgy, irrespective of the presence or absence of any complicated pretreatment step.

EXAMPLES

The invention is described more concretely with reference to Examples given herein under, but naturally, the invention should not be limited by the following Examples. Needless-to-say, the invention may be suitably changed and modified with in the scope of the sprit of the invention described hereinabove and hereinunder, and all such changes and modifications should be within the technical scope of the invention.

In the following Experimental Examples, the following lubricants were used.

(1) n-$C_2H_3(OH)_2$—CONH-n-$C_6H_{13}$
(N-hexyl)glyceric acid amide (by Nippon Seika)

(2) n-$C_2H_3(OH)_2$—CONH-n-$C_8H_{17}$
(N-octyl)glyceric acid amide (by Nippon Seika)

(3) n-$C_2H_3(OH)_2$—CONH-n-$C_{18}H_{37}$
(N-octadecyl)glyceric acid amide (by Nippon Seika)

(4) n-$C_2H_3(OH)_2$—CONH-n-$C_8H_{35}$
(N-octadecenyl)glyceric acid amide (by Nippon Seika)

(5) n-$C_2H_3(OH)_2$—CONH-n-$C_{22}H_{45}$
(N-docosyl)glyceric acid amide (by Nippon Seika)

(6) n-$C_2H_3(OH)_2$—CONH-n-$C_{24}H_{49}$
(N-tetracosyl)glyceric acid amide (by Nippon Seika)

(7) n-$C_5H_6(OH)_5$—CONH-n-$C_6H_{13}$
(N-hexyl)gluconic acid amide (by Nippon Seika)

(8) n-$C_5H_6(OH)_5$—CONH-n-$C_8H_{17}$
(N-octyl)gluconic acid amide (by Nippon Seika)

(9) n-$C_5H_6(OH)_5$—CONH-n-$C_{18}H_{37}$
(N-octadecyl)gluconic acid amide (by Nippon Seika)

(10) n-$C_5H_6(OH)_5$—CONH-n-$C_8H_{35}$
(N-octadecenyl)gluconic acid amide (by Nippon Seika)

(11) n-$C_5H_6(OH)_5$—CONH-n-$C_{22}H_{45}$
(N-docosyl)gluconic acid amide (by Nippon Seika)

(12) n-$C_5H_6(OH)_5$—CONH-n-$C_{24}H_{49}$
(N-tetracosyl)gluconic acid amide (by Nippon Seika)

(13) n-$C_7H_{35}$—COO—Zn—OCO-n-$C_{17}H_{35}$
zinc stearate (by Dainichi Kagaku)

(14) n-$C_{17}H_{35}$—CONH—$CH_2CH_2$—NHCO-n-$C_{17}H_{35}$
ethylenebis-stearylamide (by Dainichi Kagaku)

(15) $C_{15}H_{31}$—CONH—$C_{18}H_{35}$
(N-octadecenyl)hexadecanoic acid amide

Experimental Examples 1 to 14

In a V-shaped mixer (by Tsutsui Rikagaku Kiki), pure iron powder (Kobe Seikosho's trade name "Atmel 300M") and 0.75% by mass (based on the overall amount, 100% by mass, of mixed powder for powder metallurgy) of a lubricant 1 shown in the following Table 1 were mixed for 30 minutes. The apparent density, the flowability and the critical flow diameter of the resulting mixed powder for powder metallurgy were measured according to the methods mentioned below. Using the mixed powder, a shaped article was produced, and its density and the pressure for taking it out were measured according to the methods mentioned below.

(1) Apparent Density (g/cm$^3$):
Measured according to JIS Z 2504 (test method for apparent density of metal powder).

(2) Flowability (s/50 g):
Measured according to JIS Z 2502 (test method for flowability of metal powder). Briefly, the time taken by 50 g of a mixed powder to flow through a 2.63-mmϕ orifice is determined, and the time indicates the flowability of the mixed powder.

(3) Critical Flow Diameter (mm):
A cylindrical container is prepared, having an inner diameter of 114 mmϕ and a height of 150 mm and having a discharge hole in its bottom, in which the discharge diameter of the hole is variable. The discharge hole is closed, and the container is filled with 2 kg of a mixed powder. After kept as such for 10 minutes, the discharge hole is gradually opened, and the minimum diameter of the discharge hole through which the mixed power can be discharged out is measured, and the minimum diameter is the critical flow diameter of the mixed powder. The smaller critical flow diameter means better flowability of the sample.

(4) Density of Shaped Article (g/cm$^3$):
A columnar shaped article having a diameter of 25 mmϕ and a length of 15 mm is formed under a pressure of 490.3 MPa (5 T/cm$^2$) and at a room temperature (25° C.), and according to JSPM Standard 1-64 (test method for compression of metal powder), the density of the shaped article is measured.

(5) Take-Out Pressure (MPa):
The shaped article obtained in the measurement of the density of the shaped article of the above (4) is taken out of the mold, whereupon the pressure needed for the taking-out operation is measured. This is divided by the contact area between the mold and the shaped article, thereby obtaining the take-out pressure.

Experimental Examples 15 to 19

These are the same as Experimental Examples 1 to 14 mentioned above, except that a mixed powder (mixed lubricant) of a lubricant 1 and a lubricant 2 shown in the following Table 1 was used in an amount of 0.75% by mass in total (based on the overall amount, 100% by mass, of the mixed powder for powder metallurgy).

The results in Experimental Examples 1 to 19 are shown in Table 2 below. The results in Experimental Examples 1 to 6 and in Experimental Examples 7 to 12 are summarized and shown in FIG. 1.

TABLE 1

| Experimental Example | Lubricant 1 Chemical Formula | Lubricant 1 Mean Particle Size R(x) (μm) | Lubricant 2 Chemical Formula | Lubricant 2 Mean Particle Size R(y) (μm) | Lubricant 1/Lubricant 2 (ratio by mass) |
|---|---|---|---|---|---|
| 1 | n-$C_2H_3(OH)_2$—CONH-n-$C_6H_{13}$ | 12 | — | — | — |
| 2 | n-$C_2H_3(OH)_2$—CONH-n-$C_8H_{17}$ | 14 | — | — | — |
| 3 | n-$C_2H_3(OH)_2$—CONH-n-$C_{18}H_{37}$ | 11 | — | — | — |
| 4 | n-$C_2H_3(OH)_2$—CONH-n-$C_{18}H_{35}$ | 13 | — | — | — |
| 5 | n-$C_2H_3(OH)_2$—CONH-n-$C_{22}H_{45}$ | 14 | — | — | — |
| 6 | n-$C_2H_3(OH)_2$—CONH-n-$C_{24}H_{49}$ | 13 | — | — | — |
| 7 | n-$C_5H_6(OH)_5$—CONH-n-$C_6H_{13}$ | 12 | — | — | — |
| 8 | n-$C_5H_6(OH)_5$—CONH-n-$C_8H_{17}$ | 14 | — | — | — |
| 9 | n-$C_5H_6(OH)_5$—CONH-n-$C_{18}H_{37}$ | 14 | — | — | — |
| 10 | n-$C_5H_6(OH)_5$—CONH-n-$C_{18}H_{35}$ | 14 | — | — | — |
| 11 | n-$C_5H_6(OH)_5$—CONH-n-$C_{22}H_{45}$ | 12 | — | — | — |
| 12 | n-$C_5H_6(OH)_5$—CONH-n-$C_{24}H_{49}$ | 13 | — | — | — |
| 13 | n-$C_{17}H_{35}$—COO—Zn—OCO-n-$C_{17}H_{35}$ | 15 | — | — | — |
| 14 | n-$C_{17}H_{35}$—CONH—$CH_2CH_2$—NHCO-n-$C_{17}H_{35}$ | 10 | — | — | — |
| 15 | n-$C_5H_6(OH)_5$—CONH-n-$C_{18}H_{37}$ | 14 | $C_{15}H_{31}$—CONH—$C_{18}H_{35}$ | 30 | 90/10 |
| 16 | n-$C_5H_6(OH)_5$—CONH-n-$C_{18}H_{37}$ | 14 | $C_{15}H_{31}$—CONH—$C_{18}H_{35}$ | 30 | 70/30 |
| 17 | n-$C_5H_6(OH)_5$—CONH-n-$C_{18}H_{37}$ | 14 | $C_{15}H_{31}$—CONH—$C_{18}H_{35}$ | 30 | 20/80 |
| 18 | n-$C_5H_6(OH)_5$—CONH-n-$C_{18}H_{37}$ | 14 | n-$C_{17}H_{35}$—COO—Zn—OCO-n-$C_{17}H_{35}$ | 15 | 70/30 |
| 19 | n-$C_5H_6(OH)_5$—CONH-n-$C_{18}H_{37}$ | 14 | n-$C_{17}H_{35}$—CONH—$CH_2CH_2$—NHCO—$C_{17}H_{35}$ | 10 | 70/30 |

TABLE 2

| Experimental Example | Apparent Density (g/cm$^3$) | Flowability (s/50 g) | Critical Flow Diameter (mm) | Density of Shaped Article (g/cm$^3$) | Take-Out Pressure (MPa) |
|---|---|---|---|---|---|
| 1 | 3.44 | 30.6 | 35.0 | 6.87 | 15.3 |
| 2 | 3.39 | 25.6 | 15.0 | 6.88 | 13.0 |
| 3 | 3.41 | 21.4 | 12.5 | 6.89 | 9.8 |
| 4 | 3.40 | 22.0 | 12.5 | 6.90 | 9.6 |
| 5 | 3.35 | 22.4 | 12.5 | 6.88 | 11.3 |
| 6 | 3.36 | 23.2 | 15.0 | 6.87 | 12.4 |
| 7 | 3.42 | 29.4 | 35.0 | 6.88 | 14.7 |
| 8 | 3.43 | 25.3 | 12.5 | 6.89 | 12.8 |
| 9 | 3.40 | 22.0 | 10.0 | 6.90 | 9.5 |
| 10 | 3.38 | 21.8 | 10.0 | 6.90 | 10.1 |
| 11 | 3.40 | 22.2 | 12.5 | 6.88 | 11.0 |
| 12 | 3.40 | 23.0 | 12.5 | 6.88 | 12.4 |
| 13 | 3.32 | 25.8 | 15.0 | 6.90 | 13.6 |
| 14 | 3.16 | 26.7 | 25.0 | 6.88 | 15.8 |
| 15 | 3.36 | 22.0 | 10.0 | 6.90 | 8.6 |
| 16 | 3.33 | 22.3 | 12.5 | 6.90 | 8.0 |
| 17 | 3.28 | 28.9 | 25.0 | 6.89 | 7.5 |
| 18 | 3.38 | 25.3 | 12.5 | 6.88 | 10.2 |
| 19 | 3.20 | 25.5 | 10.0 | 6.89 | 10.4 |

As is obvious from Experimental Examples 13 and 14, the single use of the conventional lubricant (zinc stearate, ethylenebis-stearylamide) could not satisfy a high level of both the flowability (critical flow diameter) and the lubricity (take-out pressure).

As opposed to these, Experimental Examples 2 to 6 and 8 to 12 where a polyhydroxycarboxylic acid amide (1) of the invention is used satisfy a high level of both the flowability (critical flow diameter) and the lubricity (take-out pressure). In addition, as is obvious from FIG. 1, it is understood that, irrespective of the carboxylic acid unit of the polyhydroxycarboxylic acid amide used, when the carbon chain of the N-side hydrocarbon group in the acid amide is too short, then the flowability (critical flow diameter) and the lubricity (take-out pressure) lower, and even when the carbon chain is too long, the flowability (critical flow diameter) and the lubricity (take-out pressure) also begin to lower. Accordingly, in Experimental Examples 1 and 7 where a polyhydroxycarboxylic acid amide is used but its carbon chain is too short, the lubricants could hardly satisfy a high level of both the flowability (critical flow diameter) and the lubricity (take-out pressure).

As is obvious from Experimental Examples 15, 16 and 18, 19, the combination use of the auxiliary lubricant (lubricant 2) may control the flowability (critical flow diameter) and the lubricity (take-out pressure) within the range not having any negative influence on the invention. In particular, as is obvious from the comparison between Experimental Examples 15, 16 and Experimental 9, the combination use of the fatty acid amide (2) is remarkably effective for improving the lubricity (take-out pressure). Especially in Experimental Example 15, the lubricity (take-out pressure) could be increased, not having any negative influence on the flowability (critical flow diameter).

Experimental Examples 20 to 22

These are the same as Experimental Example 16 mentioned above, except that a mixed powder (mixed lubricant) of a lubricant 1, a lubricant 2 and a fatty acid shown in the following Table 3 was used in an amount of 0.75% by mass in total (based on the overall amount, 100% by mass, of the mixed powder for powder metallurgy).

The results are shown in Table 3.

TABLE 3

| | | Experimental Example 20 | Experimental Example 21 | Experimental Example 22 |
|---|---|---|---|---|
| Mixed Lubricant | | | | |
| Lubricant 1 | | n-$C_5H_6(OH)_5$—CONH-n-$C_{18}H_{37}$ | n-$C_5H_6(OH)_5$—CONH-n-$C_{18}H_{37}$ | n-$C_5H_6(OH)_5$—CONH-n-$C_{18}H_{37}$ |
| Lubricant 2 | | $C_{15}H_{31}$—CONH—$C_{18}H_{35}$ | $C_{15}H_{31}$—CONH—$C_{18}H_{35}$ | $C_{15}H_{31}$—CONH—$C_{18}H_{35}$ |
| Fatty Acid | | stearic acid | stearic acid | stearic acid |
| Ratio by mass | lubricant 1/lubricant 2/fatty acid | 50/30/20 | 30/30/40 | 30/20/50 |
| | (lubricant 1 + fatty acid)/lubricant 2 | 70/30 | 70/30 | 80/20 |
| | lubricant 1/lubricant 3 | 71/29 | 43/57 | 38/62 |
| Test Results | | | | |
| Apparent Density (g/cm$^3$) | | 3.29 | 3.33 | 3.35 |
| Flowability (s/50 g) | | 20.2 | 19.0 | 19.6 |
| Critical Flow Diameter (mm) | | 10.0 | 7.5 | 7.5 |
| Density of Shaped Article (g/cm$^3$) | | 6.93 | 6.91 | 6.90 |
| Take-Out Pressure (MPa) | | 6.9 | 6.6 | 7.2 |

As is obvious from Table 3, Experimental Examples 20 to 22 where a fatty acid is additionally used satisfy the highest level of both the flowability (critical flow diameter) and the lubricity (take-out pressure). In addition, these are the best in point of the flowability.

INDUSTRIAL APPLICABILITY

The invention is extremely advantageously applicable to powder metallurgy.

The invention claimed is:

1. A lubricant for powder metallurgy comprising a polyhydroxycarboxylic acid amide of the following formula (1):

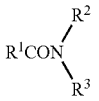

(1)

(wherein $R^1$ represents an alkyl group having from 2 to 10 carbon atoms and substituted with plural hydroxyl groups; $R^2$ represents a hydrocarbon group having from 8 to 30 carbon atoms; and $R^3$ represents a hydrogen atom, or a hydrocarbon group having from 1 to 30 carbon atoms) and an auxiliary lubricant which is at least one selected from a metal soap, an alkylenebis-fatty acid amide and a fatty acid amide of the following formula (2):

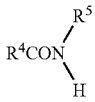

(2)

(wherein $R^4$ represents a hydrocarbon group having from 7 to 29 carbon atoms; $R^5$ represents a hydrogen atom, or a hydrocarbon group having from 1 to 30 carbon atoms).

2. The lubricant for powder metallurgy as claimed in claim 1, wherein the polyhydroxycarboxylic acid amide (1) is an aldonic acid amide.

3. The lubricant for powder metallurgy as claimed in claim 1, wherein $R^1$ has 5 carbons atoms.

4. The lubricant for powder metallurgy as claimed in claim 1, wherein $R^3$ is a hydrogen atom.

5. The lubricant for powder metallurgy as claimed in claim 1, which has a mean particle size of from 1 to 300 μm.

6. The lubricant for powder metallurgy as claimed in claim 1, wherein the fatty acid amide (2) is (N-octadecenyl)hexadecanoic acid amide or (N-octadecyl)docosenoic acid amide.

7. The lubricant for powder metallurgy as claimed in claim 1, wherein the ratio by mass of the polyhydroxycarboxylic acid amide (1) to the auxiliary lubricant (former/latter) is from 30/70 to less than 100/0.

8. The lubricant for powder metallurgy as claimed in claim 1, which further contains a fatty acid.

9. The lubricant for powder metallurgy as claimed in claim 8, wherein the fatty acid is a saturated aliphatic monocarboxylic acid having from 16 to 22 carbon atoms.

10. The lubricant for powder metallurgy as claimed in claim 8, wherein the ratio by mass of the total of the polyhydroxycarboxylic acid amide (1) and the fatty acid to the auxiliary lubricant (former/latter) is from 30/70 to less than 100/0; and the ratio by mass of the polyhydroxycarboxylic acid amide (1) to the fatty acid (former/latter) is from 20/80 to less than 100/0.

11. A mixed powder for powder metallurgy, prepared by mixing a lubricant for powder metallurgy of claim 1 and a metal powder.

12. A method for producing a sintered body, comprising shaping a mixed powder for powder metallurgy of claim 11 through compression followed by sintering it.

13. A lubricant for powder metallurgy comprising a polyhydroxycarboxylic acid amide of the following formula (1):

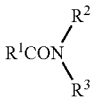

(1)

(wherein $R^1$ represents an alkyl group substituted with plural hydroxyl groups, provided that the number of the carbon atoms constituting the alkyl group is an integer selected from a range of from n to 5×n, in which n indicates the number of the substituted hydroxyl groups; $R^2$ represents a hydrocarbon group having from 8 to 30 carbon atoms; and $R^3$ represents a hydrogen atom, or a hydrocarbon group having from 1 to 30 carbon atoms), which further contains an auxiliary lubricant and in which the auxiliary lubricant is at least one selected from a metal soap, an alkylenebis-fatty acid amide and a fatty acid amide of the following formula (2):

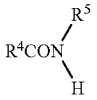

(2)

(wherein $R^4$ represents a hydrocarbon group having from 7 to 29 carbon atoms; $R^5$ represents a hydrogen atom, or a hydrocarbon group having from 1 to 30 carbon atoms).

14. The lubricant for powder metallurgy as claimed in claim 13, wherein the fatty acid amide (2) is (N-octadecenyl) hexadecanoic acid amide or (N-octadecyl)docosenoic acid amide.

15. The lubricant for powder metallurgy as claimed in claim 13, wherein the ratio by mass of the polyhydroxycarboxylic acid amide (1) to the auxiliary lubricant (former/latter) is from 30/70 to less than 100/0.

16. The lubricant for powder metallurgy as claimed in claim 13, which further contains a fatty acid.

17. The lubricant for powder metallurgy as claimed in claim 16, wherein the fatty acid is a saturated aliphatic monocarboxylic acid having from 16 to 22 carbon atoms.

18. The lubricant for powder metallurgy as claimed in claim 16, wherein the ratio by mass of the total of the polyhydroxycarboxylic acid amide (1) and the fatty acid to the auxiliary lubricant (former/latter) is from 30/70 to less than 100/0; and the ratio by mass of the polyhydroxycarboxylic acid amide (1) to the fatty acid (former/latter) is from 20/80 to less than 100/0.

19. A mixed powder for powder metallurgy, prepared by mixing a lubricant for powder metallurgy of claim 1, and a metal powder.

20. A method for producing a sintered body, comprising shaping a mixed powder for powder metallurgy of claim 19 through compression followed by sintering it.

* * * * *